US008171902B2

(12) United States Patent
Weber

(10) Patent No.: US 8,171,902 B2
(45) Date of Patent: May 8, 2012

(54) CAMSHAFT ADJUSTER AND DEEP-DRAWING METHOD FOR PRODUCING A SEAL COVER FOR A CAMSHAFT ADJUSTER

(75) Inventor: Jürgen Weber, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 449 days.

(21) Appl. No.: 12/498,653

(22) Filed: Jul. 7, 2009

(65) Prior Publication Data

US 2010/0000480 A1 Jan. 7, 2010

(30) Foreign Application Priority Data

Jul. 7, 2008 (DE) ..... 10 2008 032 030

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,418,897 B1 * 7/2002 Urban et al. ..... 123/90.17

FOREIGN PATENT DOCUMENTS

DE 102005020529 11/2006

* cited by examiner

*Primary Examiner* — Zelalem Eshete
(74) *Attorney, Agent, or Firm* — Volpe and Koenig, P.C.

(57) ABSTRACT

A camshaft adjuster (1) for an internal combustion engine of a motor vehicle with a radially outer stator (4) that can be driven by the crankshaft, a radially inner rotor (5) connected locked in rotation with the camshaft (2), working chambers (6) that are arranged between the rotor (5) and the stator (4) and that can be pressurized with a pressure such that the relative rotational position of the rotor (5) to the stator (4) is adjustable, at least one seal cover (7) bordering the working chambers (6) on the sides and contacting the rotor (5) and the stator (4) in a sealing way, with an annular disk-shaped base body (13) and an annular projection (9) encompassing the camshaft (2) and adjacent to the radial inside of the base body (13). The base body (13) contacts, with a seal surface (D), the rotor (5) and transitions via a radius (10) into the annular projection (9). A bead (11) is provided on the annular disk-shaped base body (13) on the side facing away from the rotor (5) in the region bordering the annular projection (9).

5 Claims, 6 Drawing Sheets

CAMSHAFT ADJUSTER AND DEEP-DRAWING METHOD FOR PRODUCING A SEAL COVER FOR A CAMSHAFT ADJUSTER

CROSS-REFERENCE TO RELATED APPLICATIONS

This application claims the benefit of German patent application no. 10 2008 032 030.7, filed Jul. 7, 2008, which is incorporated herein by reference as if fully set forth.

BACKGROUND

The invention relates to a camshaft adjuster and a deep-drawing method for producing a seal cover for a camshaft adjuster.

From DE 10 2005 020 529 A1, a camshaft adjuster according to the class is already known with a seal cover, designated in that document as a side leg, which has an annular disk-shaped base body that contacts the rotor by via a seal surface and transitions into a tubular projection via a radius. In particular, in a seal surface with very small dimensions, the risk arises that the seal surface is reduced or even no longer present by a possibly larger radius caused by production inaccuracies. Therefore, the risk arises that the pressure can escape from the working chambers and the camshaft adjuster can no longer carry out its function without problems.

SUMMARY

The objective of the invention is to provide a camshaft adjuster, as well as a deep-drawing method for producing the camshaft adjuster, which overcomes the disadvantages noted above.

For solving the problem, according to the invention it is provided that a bead is provided on the annular disk-shaped base body on the side facing away from the rotor in the region bordering the tubular projection. The bead intentionally forms a narrowing of the annular disk-shaped base body, so that the pressure on the material is especially large in this region during production and material cannot escape or so that material is even pressed into the region of the radius. Therefore, the risk that the seal surface becomes smaller due to production inaccuracies and an unintentional increase of the radius is significantly reduced.

So that the improvement of the sealing effect is also implemented uniformly across the periphery and that no error points are generated, it is further provided that the bead has a ring-shaped configuration.

It has been shown that the effect of the plastic material flux is achieved in an especially good way by the impression of the bead when the seal cover is produced from a lightweight metal, advantageously from aluminum or from a sintered blank. Sintered blanks are possible in this respect, because under pressure the sintered material forms a mass that can be shaped and that can be pressed especially well into the radius. Lightweight metals, advantageously aluminum, have the property that, even in the deep-drawing method, the relatively low plastic deformation limit is quickly exceeded, so that the effect of the material flux can be generated relatively easily and selectively.

Furthermore, for meeting the objective, a deep-drawing method for producing a seal cover for a camshaft adjuster with an annular disk-shaped base body having a seal surface and an annular projection connecting to the radial inside of the base body is proposed in which the base body transitions into the annular projection via a radius, wherein, on the side of the seal cover opposite the radius, a bead is impressed and therefore material is forced into the region of the radius.

With the deep-drawing method according to the invention, the advantage is provided that, during the deep drawing process, very large internal stresses are generated by the impressed bead, so that material is forced from the bead by exceeding the elastic deformation limit in the region of the radius and the form is maintained by the resulting plastic deformation after the deep drawing.

So that the material is forced selectively in the direction of the radius and does not escape outwards, it is further proposed that a radially inward compressive force is applied to the annular disk-shaped base body on its radial outer side and/or this base body is supported on its radially outer peripheral surface by a counter surface. Through the compressive force provided, a possibility is further created to press additional material in the direction of the radius during shaping. This has been shown to be advantageous especially for the use of seal covers made from aluminum in which a material flux is also possible across larger radii. Furthermore, relatively thin-walled seal covers with sharp-edged radii could also be deep drawn.

BRIEF DESCRIPTION OF THE DRAWINGS

Below, the invention will be explained in greater detail with reference to a preferred embodiment. Shown are.

DETAILED DESCRIPTION OF THE PREFERRED EMBODIMENTS

Figure 1:
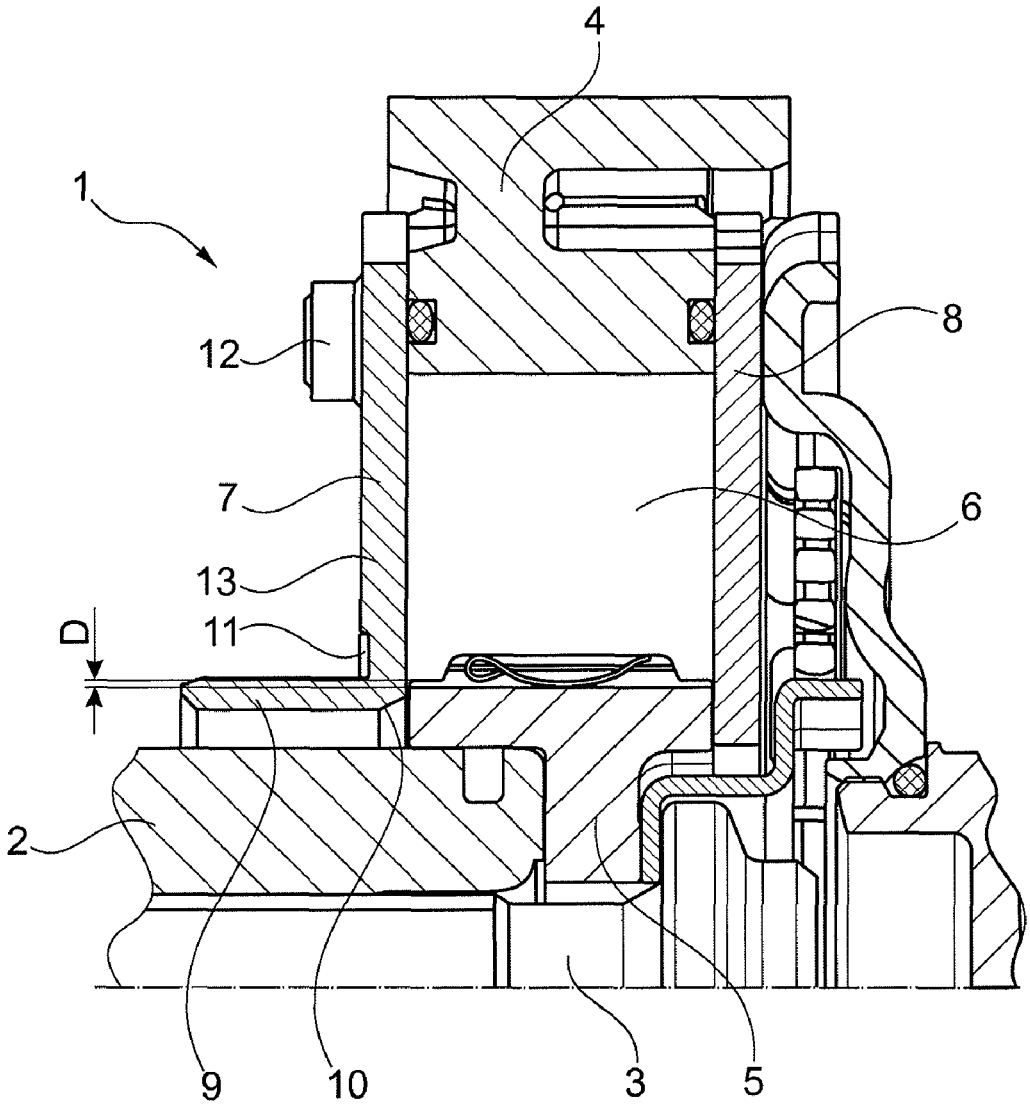
FIG. 1 is a view of a camshaft adjuster with seal cover.

In FIG. 1, a camshaft adjuster 1 is shown with a stator 4 driven by a crankshaft (not shown) of an internal combustion engine, and a rotor 5 connected locked in rotation with a camshaft 2 by a central screw 3. Between the stator 4 and the rotor 5 there is a working chamber 6 that is bordered on the sides by a seal cover 7 and a seal disk 8. The working chamber 6 can be pressurized with a pressure agent, so that the relative rotational position of the rotor 5 to the stator 4 and thus also the camshaft 2 relative to the crankshaft can be changed. The seal cover 7 is connected rigidly to the stator 4 with a screw 12 and contacts the rotor 5 with a seal surface "D". The seal cover 7 has a basic setup formed by an annular disk-shaped base body 13 and an annular projection 9 connecting to the radial inside with the formation of a radius 10.

Figure 2:
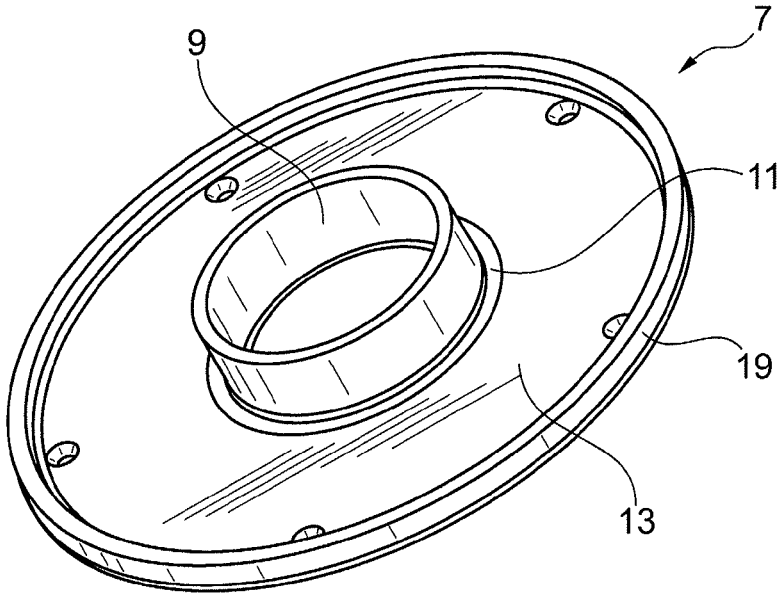
FIG. 2 is a perspective view of the seal cover.
Figure 3:
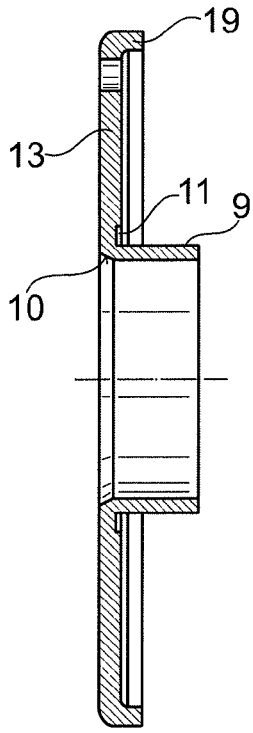
FIG. 3 is a sectional view of the seal cover.

In FIG. 2, the seal cover 7 is to be seen in perspective view, where the cover is provided in the region of the annular disk-shaped base body 13 bordering the projection 9 with an annular bead 11. In the transition of the annular disk-shaped base body 13 to the annular projection 9, a radius 10 is provided that is formed by the bead 11 with a sharper edge than would be the case without the bead, as is to be seen in FIG. 3. Through the use of the bead 11, a region of smaller cross section is intentionally generated in the seal cover 7 in which a higher pressure is generated during the production of the seal cover 7. Through this higher pressure, the material is forced into the region of the radius 10 during the injection into the injection-molding mold, the pressing into a sintering mold, or the deep drawing process, which is used in an especially preferred case, so that this cannot turn out smaller due to inaccuracies in production.

Figure 4:
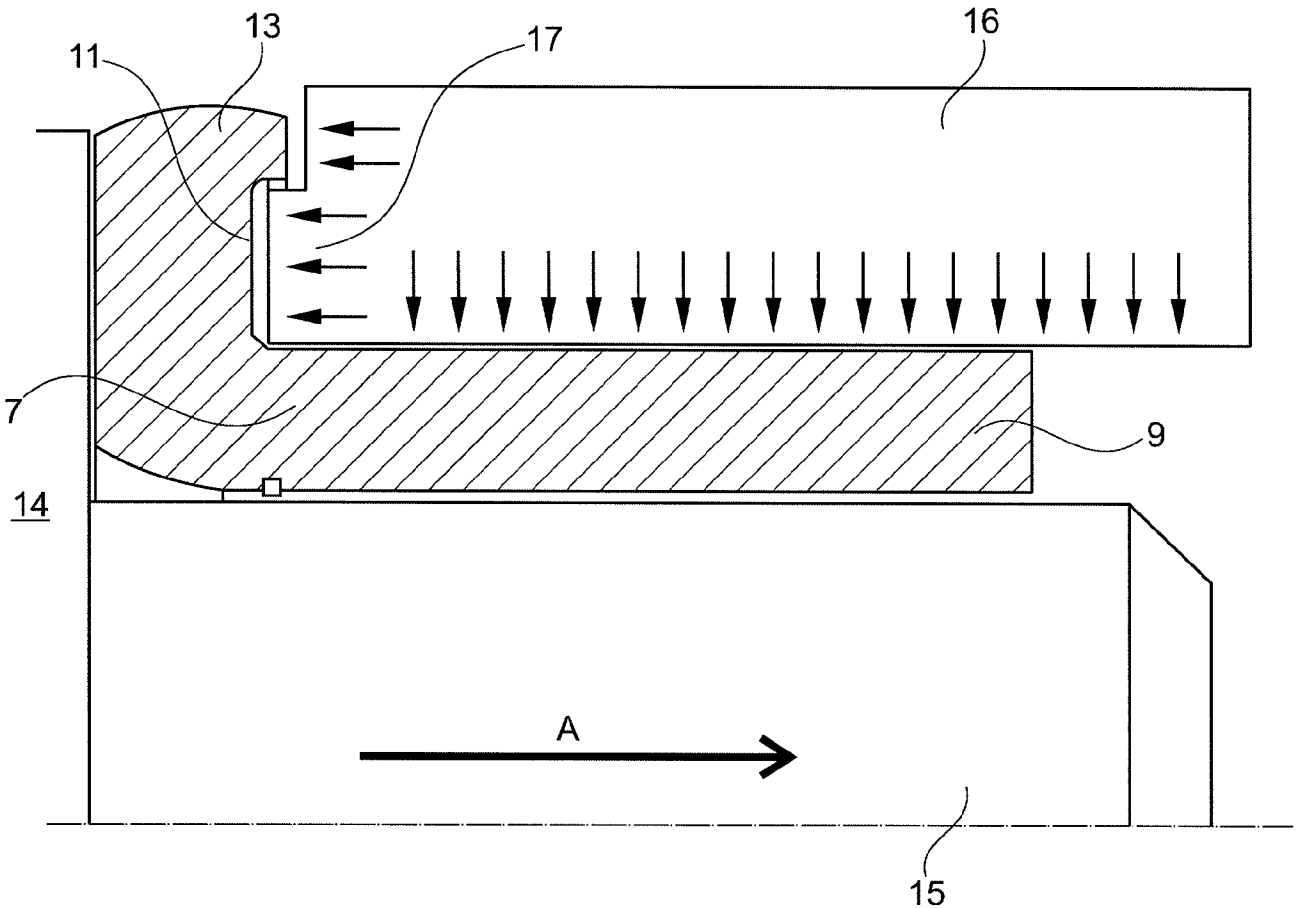
FIG. 4 is a view of the seal cover with bead during the deep drawing.
Figure 5:
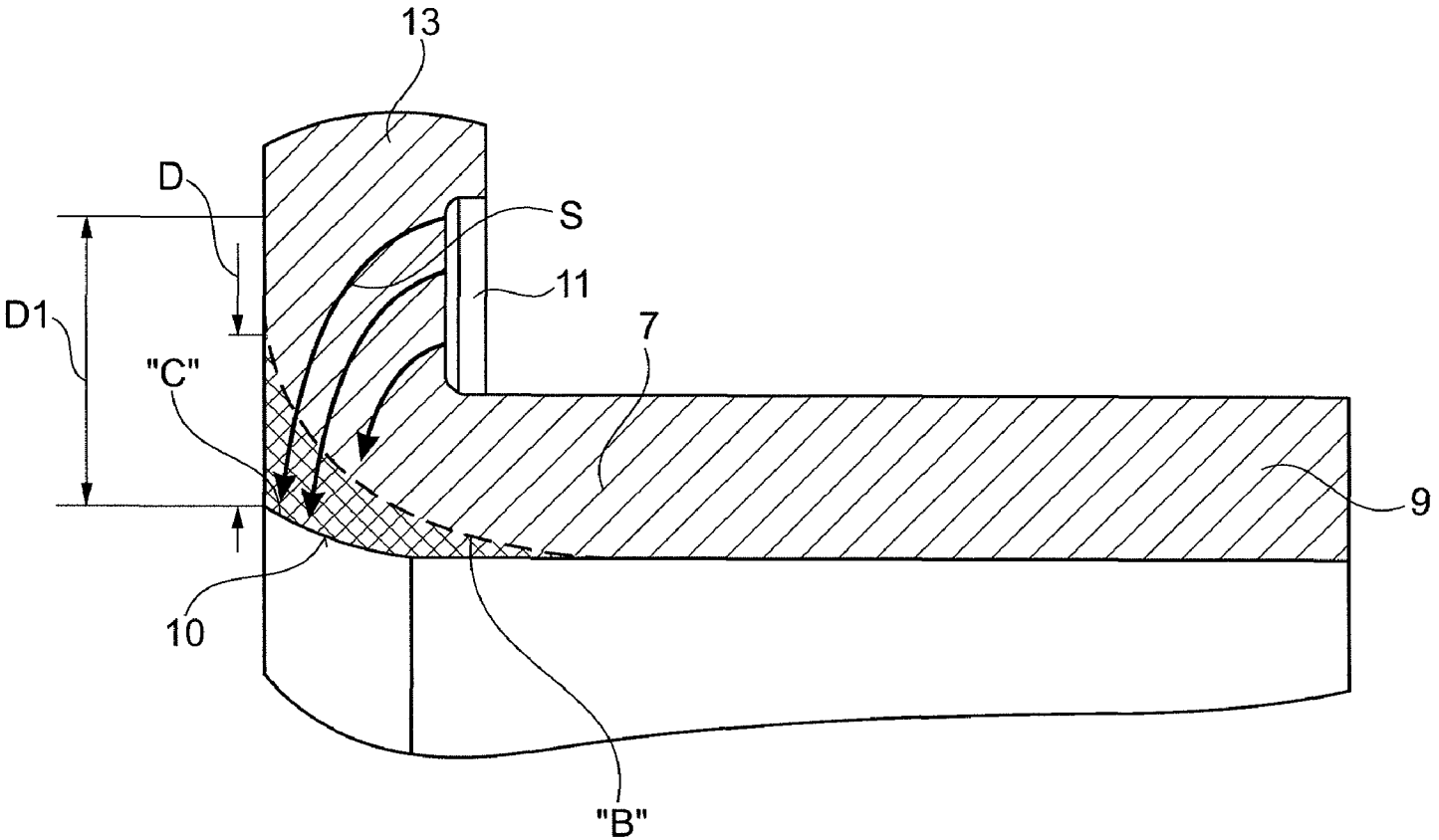
FIG. 5 is a view of a seal cover with bead after the deep drawing with increased seal surface.

In FIG. 4, the deep-drawing method for the seal cover 7 is shown with a deep-drawing mold 14, a drawing mandrel 15 arranged thereon, and a blank holder 16. The seal cover 7 is placed as a blank into the blank holder 16. Then the deep-drawing method 14 is carried out, with the drawing mandrel 15, an adjustment movement in the direction "A", so that the annular projection 9 is deep drawn from the annular disk-shaped base body 13. The blank holder 16 that is fixed in place during the deep drawing process is provided on its end facing the seal cover 7 with a shoulder 17 through which the bead 11 is impressed into the annular disk-shaped base body 13 due to the compressive force exerted by the deep-drawing mold 14. In FIG. 5, the seal cover 7 is shown with contours shown by the dashed line "B" that presents the profile of the radius 10 without impressing the bead 11. By impressing the bead 11, a part of the material is now pressed along the material flux lines "S" into the region of the radius 10 under plastic deformation, so that, instead of the radius "B", sharper-edged counters "C", also designated as radius 10, are created.

The material forced from the bead 11 corresponds to the crosshatched area between the contours "B" and the contours "C". Furthermore, a seal surface "D" is created that is enlarged by the area "D1" and that can be seen adjacent to the rotor 5.

Figure 6:
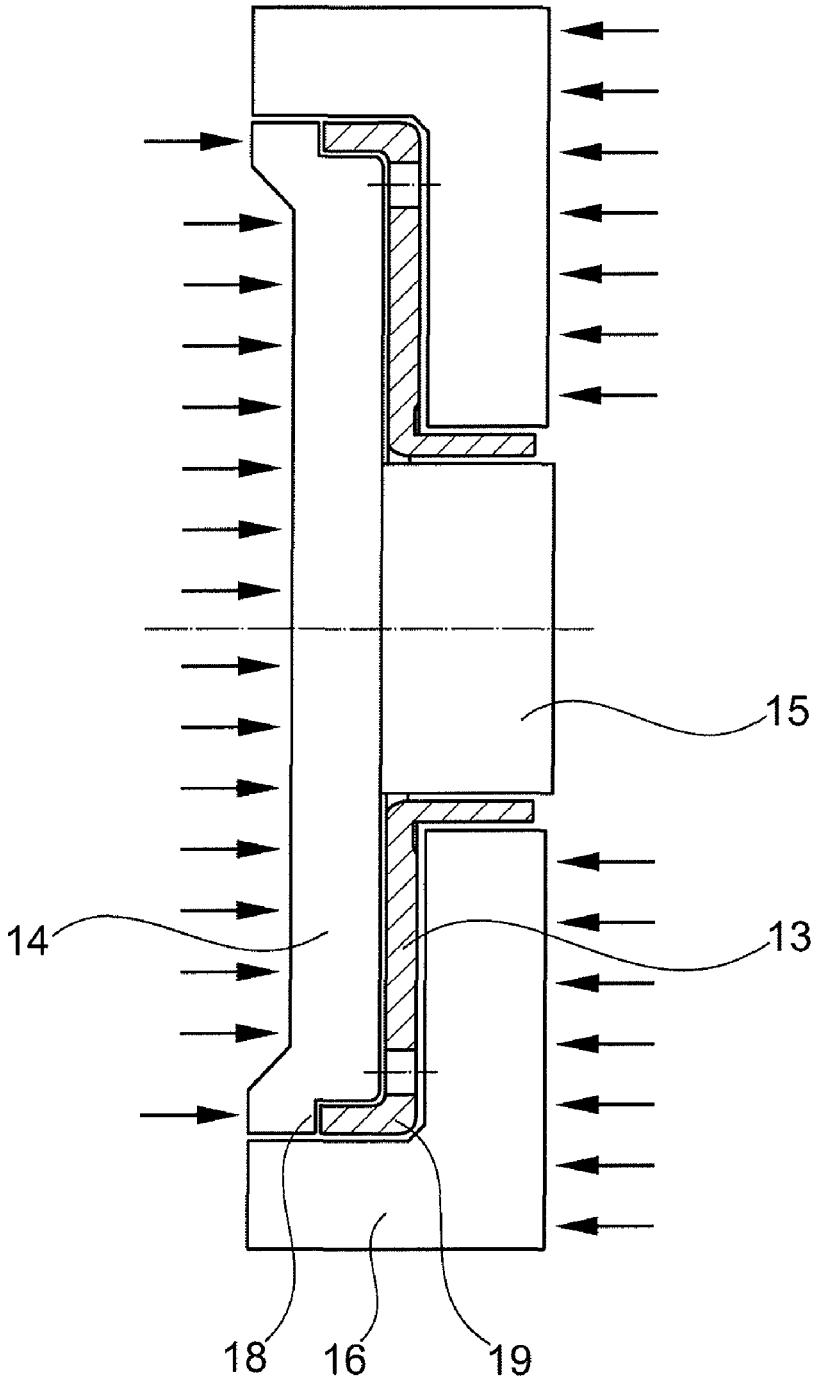
FIG. 6 is a view of the seal cover with collar on the outer diameter.
Figure 7:
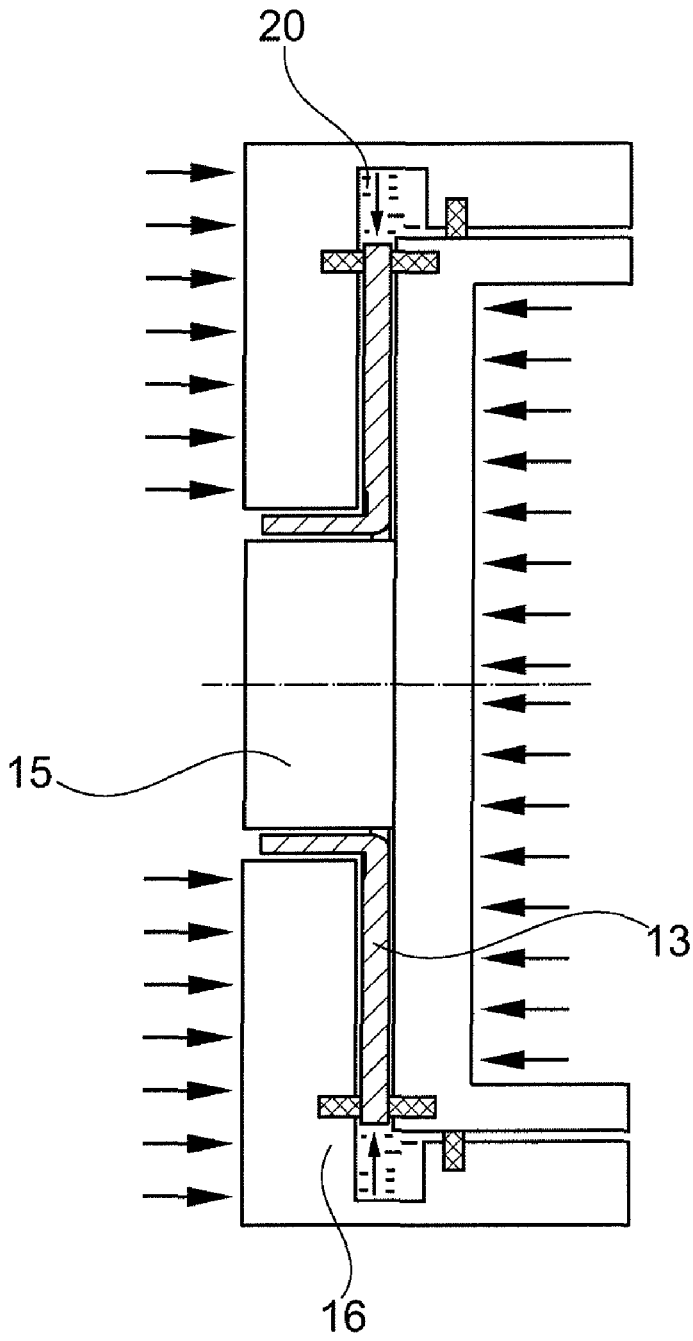
FIG. 7 is a view of the seal cover with pressurization on the outer diameter.

In FIG. 6, an improvement of the invention is shown in which a collar 19 is provided on the outer radius of the annular disk-shaped base body 13. By using this collar, it is prevented that by the impression of the bead 11, material is forced outward. First, the collar 19 is supported around the periphery by the blank holder 16 and, second, the end of the collar 19 is pressurized by a shoulder 18 in the deep-drawing mold 14 with a compressive force directed in the axial direction, so that the seal cover 7 is supported in this region with an overall dimension stabilizing way. Furthermore, with corresponding dimensioning of the collar 19 and the deep-drawing mold 14 with the shoulder 18 arranged thereon, material can be forced radially inward into the annular disk-shaped base body, so that, in this way, additional material is forced into the region of the radius 10. Alternatively, the same effect could be achieved in that the annular disk-shaped base body 13 is pressurized on its radially outer side by a pressure space 20 with a radially inward directed pressure, as shown in FIG. 7.

The invention claimed is:

1. Camshaft adjuster for an internal combustion engine of a motor vehicle, comprising a radially outer stator that can be driven by a crankshaft of the internal combustion engine, a radially inner rotor connected locked in rotation with a camshaft, working chambers that are arranged between the rotor and the stator and that can be pressurized with a pressure agent such that a relative rotational position of the rotor to the stator is adjustable, at least one seal cover bordering the working chambers on the sides and contacting the rotor and the stator in a sealing manner, with an annular disk-shaped base body and an annular projection encompassing the camshaft and adjacent to a radial inside of the base body, wherein the base body contacts, with a seal surface, the rotor and transitions via a radius into the annular projection, a bead is provided on the annular disk-shaped base body on a side facing away from the rotor in a region bordering the annular projection.

2. Camshaft adjuster according to claim 1, wherein the bead has an annular configuration.

3. Camshaft adjuster according to claim 1, wherein the seal cover is produced from a lightweight metal.

4. Camshaft adjuster according to claim 1, wherein the seal cover is produced from a sintered blank.

5. Camshaft adjuster according to claim 1, wherein the seal cover is produced from aluminum.

* * * * *